US005537198A

United States Patent [19]

Jackson

[11] Patent Number: 5,537,198

[45] Date of Patent: Jul. 16, 1996

[54] DOUBLE SPLIT RECHARGE METHOD AND APPARATUS FOR COLOR IMAGE FORMATION

[75] Inventor: Mark S. Jackson, Rochester, N.Y.

[73] Assignee: Xerox Corporation, Stamford, Conn.

[21] Appl. No.: 354,392

[22] Filed: Dec. 12, 1994

[51] Int. Cl.[6] ..... C03G 15/01

[52] U.S. Cl. ..... 355/326 R; 355/246; 355/327

[58] Field of Search ..... 355/208, 219, 355/221, 246, 326 R–328

[56] References Cited

U.S. PATENT DOCUMENTS

| | | | |
|---|---|---|---|
| 4,033,688 | 7/1977 | Orthmann | 355/233 |
| 4,141,648 | 2/1979 | Gaitten et al. | 355/225 |
| 4,432,631 | 2/1984 | Bacon et al. | 355/225 |
| 4,660,059 | 4/1987 | O'Brien | 346/157 |
| 4,761,669 | 8/1988 | Langdon | 355/326 R |
| 4,791,452 | 12/1988 | Kasai et al. | 355/326 R |
| 4,819,028 | 4/1989 | Abe | 355/326 R X |
| 4,833,503 | 5/1989 | Snelling | 355/259 |
| 5,208,636 | 5/1993 | Rees et al. | 355/219 |
| 5,241,356 | 8/1993 | Bray et al. | 355/328 |
| 5,258,820 | 11/1993 | Tabb | 355/328 |
| 5,408,299 | 4/1995 | Haas | 355/327 X |

FOREIGN PATENT DOCUMENTS 1-340663 9/1991 Japan .

*Primary Examiner*—William J. Royer
*Attorney, Agent, or Firm*—John M. Kelly

[57] ABSTRACT

In a multi-color imaging apparatus utilizing a recharge step between two image creation steps for recharging a charge retentive surface to a predetermined potential pursuant to forming the second of the two images, a first corona generating device recharges the charge retentive surface with a direct current to a higher absolute potential than a predetermined potential, a second corona generating device recharges the charge retentive surface with a direct current to a lower absolute potential than the predetermined potential, and then a third corona generating device recharges the surface, also with a direct current, to the predetermined potential. An electrical charge associated with the first image is prevented from reversing its original polarity after being recharged by the third corona generating device, thereby preventing the occurrence of under color splatter of the toner image.

20 Claims, 3 Drawing Sheets

DOUBLE SPLIT RECHARGE METHOD AND APPARATUS FOR COLOR IMAGE FORMATION

BACKGROUND OF THE INVENTION

This invention relates generally to color imaging and more particularly to the use of plural exposure and development steps for such purposes.

One method of printing in different colors is to uniformly charge a charge retentive surface and then optically expose the surface to information to be reproduced in one color. This information is rendered visible using marking particles followed by the recharging of the charge retentive surface prior to a second exposure and development. This recharge/expose/and develop process may be repeated to subsequently develop images of different colors in superimposed registration on the surface before the full color image is subsequently transferred to a support substrate. The different colors may be developed on the photoreceptor in an image on image development process, or a highlight color image development process (image next-to image). The images may be formed by using a single exposure device, e.g. ROS, where each subsequent color image is formed in a subsequent pass of the photoreceptor (multiple pass). Alternatively, each different color image may be formed by multiple exposure devices corresponding to each different color image, during a single revolution of the photoreceptor (single pass).

Several issues arise that are unique to the image on image process of creating multi-color images in the attempt to provide optimum conditions for the development of subsequent color images onto previously developed color images. For example, during a recharge step, it is important to level the voltages among previously toned and untoned areas of the photoreceptor so that subsequent exposure and development steps are effected across a uniformly charged surface. The greater the difference in voltage between those image areas of the photoreceptor previously subjected to a development and recharge step; those image areas subjected to a development step, but not yet subjected to a recharge step; and those bare non-developed, untoned areas of the photoreceptor, the larger will be the difference in the development potential between these areas for the subsequent development of image layers thereon.

Another issue that must be addressed with the image on image color image formation process is the residual voltage that exists across the toner layer of a previously developed area of the photoreceptor. Although it may be possible to achieve voltage uniformity by recharging previously developed photoreceptor areas to the same voltage level as neighboring bare areas, this residual toner voltage ($V_t$) prevents the effective voltage above any previously developed toned areas from being re-exposed and discharged to the same level as neighboring bare photoreceptor areas which have been exposed and discharged to the actual desired voltage levels. The problems become increasingly severe as additional color images are subsequently exposed and developed thereon. Color quality is severely threatened by the presence of the toner charge and the resultant voltage drop across the toner layer. The change in voltage due to the toned image can be responsible for color shifts, toner spreading at image edges, and loss in latitude affecting many of the photoreceptor subsystems. Thus, it is ideal to reduce or eliminate the residual toner voltage of any previously developed toned images.

Prior attempts to address one or more of these issues have introduced a variety of secondary problems, each having an adverse effect on the image on image color image formation process. For example, copending application for U.S. Patent entitled "Method and Apparatus for Reducing Residual Toner Voltage", U.S. patent application Ser. No. 08/347,616, filed by a common assignee as the present application, discloses a voltage sensitive recharge device used for the recharging steps during a color image formation, whose graph of the output current (I) to the charge retentive surface as a function of the voltage to the charge retentive surface (V) has a high (I/V) slope. The high I/V slope recharge device disclosed having an AC voltage supplied thereto, enables an extended time for neutralization to occur at the top of the toner layers. However, this system causes a significant amount of excess current to pass through the toner layer, severely impairing the subsequent attempt to transfer the image from the photoreceptor.

Another recharging method is described in application for Japanese Patent No. Hei 1-340663, Application date Dec. 29, 1989, Publication date Sept. 4, 1991, assigned to Matsushita Denki Sangyo K. K. This reference discloses a color image forming apparatus wherein a first and second charging device are used to recharge a photoconductor carrying a first developed image, before exposure and development of a subsequent image thereon. The potential of the photoconductor is higher after passing the first charging device than after passing the second charging device. This reference teaches that the difference in voltage applied by the first and second charging devices to the toner image and photoreceptor surface is set to a relatively high level, to insure that the polarity of the toner image is reversed after passing and having been charged by both devices. The effect of this teaching is to reduce the residual voltage in the image areas which becomes more severe when applying color toners onto previously developed color toners, and also to prevent toner spray or spread during the exposure process. Toner spray is a phenomena caused when the photoconductor carrying the first toner image is recharged to a relatively high charge level and then exposed for the second image development. The toner of the first image tends to spray along its edges into the subsequently exposed areas which have a relatively lower charge level. By reversing the polarity of the toner as taught in this reference, toner spray is prevented, as the reversed polarity toner is no longer attracted to the exposed areas.

When a substantial amount of toner charge at the top of a previously developed toner layer is reversed in polarity during recharge, however, a different problem of a serious nature develops. Since the prior toner image is now predominantly of an opposite polarity to both the background bare areas and the incoming color toner to be developed thereon, an interaction occurs among these three separate and distinctly charged regions. Particularly, the now-positively charged toner layer is attracted to the negatively charged background areas and the negatively charged toner of the incoming color image. Thus, the positively charged toner of the first image tends to splatter within the developed image and also into neighboring bare background regions. This occurrence has been titled the "under color splatter" defect (UCS) and is the cause for the unwanted blending of colors and the spreading of colors from image edges into background areas. Consequently, color clarity is severely impacted.

Copending application for U.S. Patent entitled "Split Recharge Method and Apparatus for Color Image Formation", U.S. patent application Ser. No. 08/347,617, filed by a common assignee as the present application, discloses a recharge method which attempts to solve the UCS problem. This reference discloses a split recharge configuration wherein a first corona generating device recharges the charge retentive surface having a developed image thereon to a higher absolute potential than a predetermined potential, and then a second corona generating device having an AC voltage supplied thereto recharges the surface to the predetermined potential. The amount of difference in the photoreceptor surface potential after being recharged by the first corona recharge device and the second corona recharge device is defined as the "voltage split". The alternating current generated from the second recharge device substantially neutralizes the electrical charge associated with the image. The teachings of this disclosure also enable a reduced residual toner voltage ($V_t$) associated with the toned image, as the amount of voltage split applied is directly proportional to the amount of $V_t$ reduction realized. However, in order to avoid the toned image charge from reversing its polarity (to avoid UCS occurrence), the amount of voltage split that can be applied is limited, which in turn limits the amount of residual toner voltage reduction that can be achieved. Furthermore, the process of substantially neutralizing the top toner layer in the attempt to prevent the toner charge from reversing its polarity causes large amounts of current to be driven through the toner layer and into the photoreceptor, making transfer of the image from the photoreceptor and optimization of image quality a difficult process.

Based on the foregoing, a highly reliable and consistent manner of recharging the photoreceptor to a uniform level is needed, whereby the residual voltage on previously toned areas is minimized and the undercolor splatter defect is prevented. Furthermore, a recharging process is needed whereby large amounts of current are not driven through the toner layers, causing difficulty to the subsequent transfer process.

The following references may be found relevant to the present disclosure.

U.S. Pat. No. 4,791,452 relates to a two-color imaging apparatus wherein a first latent image is formed on a uniformly charged imaging surface and developed with toner particles. The charge retentive surface containing a first developed or toned image, and undeveloped or untoned background areas is then recharged by a scorotron charging device prior to optically exposing the surface to form a second latent electrostatic image thereon. An electrical potential sensor detects the surface potential level of the drum to ensure that a prescribed surface potential level is reached. The recharging step is intended to provide a uniformly charged imaging surface prior to effecting a second exposure.

U.S. Pat. No. 4,819,028 discloses an electrophotographic recording apparatus capable of forming a clear multicolor image including a first visible image of a first color and a second visible image of a second color on a photoconductive drum. The electrophotographic recording apparatus is provided with a conventional charger unit and a second corona charger unit for charging the surface of the photoconductive drum after the first visible image is formed thereon so as to increase the surface potential of the photoconductive drum to prevent the first visible image from being mixed with a second color and also from being scratched off from the surface of the photoconductive drum by a second magnetic brush developing unit.

U.S. Pat. No. 4,761,669 relates to creating two-color images. A first image is formed using the conventional xerographic process. Thus, a charge retentive surface is uniformly charged followed by light exposure to form a latent electrostatic image on the surface. The latent image is then developed. A corona generator device is utilized to erase the latent electrostatic image and increase the net charge of the first developed image to tack it to the surface electrostatically. This patent proposes the use of an erase lamp, if necessary, to help neutralize the first electrostatic image. A second electrostatic image is created using an ion projection device. The ion image is developed using a second developer of a different color.

U.S. Pat. No. 4,033,688 discloses a color copying apparatus which utilizes a light-lens scanning device for creating plural color images. This patent discloses multiple charge/expose/develop steps.

U.S. Pat. No. 4,833,503 discloses a multi-color printer wherein a recharging step is employed following the development of a first image. This recharging step, according to the patent is used to enhance uniformity of the photoreceptor potential, i.e. neutralize the potential of the previous image.

U.S. Pat. No. 4,660,059 discloses an ionographic printer. A first ion imaging device forms a first image on the charge retentive surface which is developed using toner particles. The charge pattern forming the developed image is neutralized prior to the formation of a second ion image by a corona generating unit and an erase lamp.

U.S. Pat. No. 5,208,636, discloses a printing system wherein charged area images and discharged area images are created, the former being formed first and the latter being proceeded by a recharging of the imaging surface.

U.S. Pat. No. 5,241,356 discloses a multi-color printer wherein charged area images and discharged area images are created, the former being formed first, followed by an erase step and a recharge step before the latter is formed. An erase lamp is used during the erase step to reduce voltage non-uniformity between toned and untoned areas on a charge retentive surface.

U.S. Pat. No. 5,258,820 discloses a multi-color printer wherein charged area images and discharged area images are created. An erase lamp is used following development of a charged area (CAD), and a pre-recharge corona device is used following development of a discharged area (DAD) and prior to a recharge step, to reduce voltage non-uniformity between toned and untoned images on a charge retentive surface.

Copending application for U.S. patent application Ser. No. 08/346,708, filed by a common assignee as the present application, discloses a corona recharge device for recharging the photoreceptor containing at least one previously developed color image, to a voltage level intermediate to the background areas and the image areas, to keep wrong-charge toner developed in the background areas at a charge level distinct from the toner developed in the image areas so that the wrong-charge background toner does not transfer to a support substrate with the image.

A number of commercial printers employ the charge/expose/develop/recharge imaging process. For example, the Konica 9028, a multi-pass color printer forms a single color image for each pass. Each such pass utilizes a recharge step following development of each color image. The Panasonic FPC1 machine, like the Konica machine is a multi-pass color device. In addition to a recharge step the FPC1 machine employs an AC corona discharge device prior to recharge.

SUMMARY OF THE INVENTION

In accordance with one aspect of the invention, a corona generating device recharges a charge retentive surface to a predetermined potential. The charge retentive surface has at least one image developed thereon having a residual voltage and an electrical charge of a first polarity associated therewith. A first corona generating device positioned adjacent the charge retentive surface, recharges the charge retentive surface to a higher absolute potential than the predetermined potential. A second corona generating device, spaced from the first corona generating device and positioned adjacent the charge retentive surface, subsequently recharges the charge retentive surface to a lower absolute potential than the predetermined potential. The difference in charge retentive surface potential after being recharged by the first corona generating device and the second corona generating device is preselected so as to substantially reduce the residual voltage associated with the developed image. A third corona generating device, spaced from said second corona generating device and positioned adjacent the charge retentive surface, then recharges the charge retentive surface to the predetermined potential. The difference in charge retentive surface potential after being recharged by the second corona generating device and the predetermined potential is preselected so as to establish the first polarity of the electrical charge associated with the developed image. A direct current is applied to the charge retentive surface by the first, second, and third corona generating devices, so as to optimize the reduction of both the residual voltage of the toner image as well as the occurrence of under color splatter.

In accordance with another aspect of the invention, a printing machine for creating multiple images is disclosed, comprising a charge retentive surface having a developed image thereon, the developed image having a residual voltage and an electrical charge of a first polarity associated therewith. The machine also comprises a corona generating device for recharging the charge retentive surface to a predetermined voltage, whereby a first corona generating device positioned adjacent the charge retentive surface, recharges the charge retentive surface to a higher absolute potential than the predetermined potential. A second corona generating device, spaced from the first corona generating device and positioned adjacent the charge retentive surface, subsequently recharges the charge retentive surface to a lower absolute potential than the predetermined potential. The difference in charge retentive surface potential after being recharged by the first corona generating device and the second corona generating device is preselected so as to substantially reduce the residual voltage associated with the developed image. A third corona generating device, spaced from said second corona generating device and positioned adjacent the charge retentive surface, then recharges the charge retentive surface to the predetermined potential. The difference in charge retentive surface potential after being recharged by the second corona generating device and the predetermined potential is preselected so as to establish the first polarity of the electrical charge associated with the developed image.

In accordance with yet another aspect of the invention, a method for creating multiple images is disclosed. The method comprises the steps of recording a latent image on a charge retentive surface, developing the latent image, the developed image having an electrical charge of a first polarity associated therewith, and predetermining a surface potential for recharging the charge retentive surface and the developed image thereto. The method then includes recharging the charge retentive surface with a first corona generating device to a higher absolute potential than the predetermined potential, then recharging the charge retentive surface with a second corona generating device to a lower absolute potential than the predetermined potential, and then recharging the charge retentive surface with a third corona generating device to the predetermined potential, so that the electrical charge associated with the developed image is at the first polarity, thereby eliminating the occurrence of under color splatter.

BRIEF DESCRIPTION OF THE DRAWINGS

FIG. 3 shows the photoreceptor voltage profile after an exposure step;

FIG. 3 shows the photoreceptor voltage profile after a development step subsequent to the exposure step of FIG. 3B;

DETAILED DESCRIPTION OF THE PREFERRED EMBODIMENT OF THE INVENTION

This invention relates to an imaging system which is used to produce an image on image color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass image on image color process system, and a single or multiple pass highlight color system.

Figure 1:
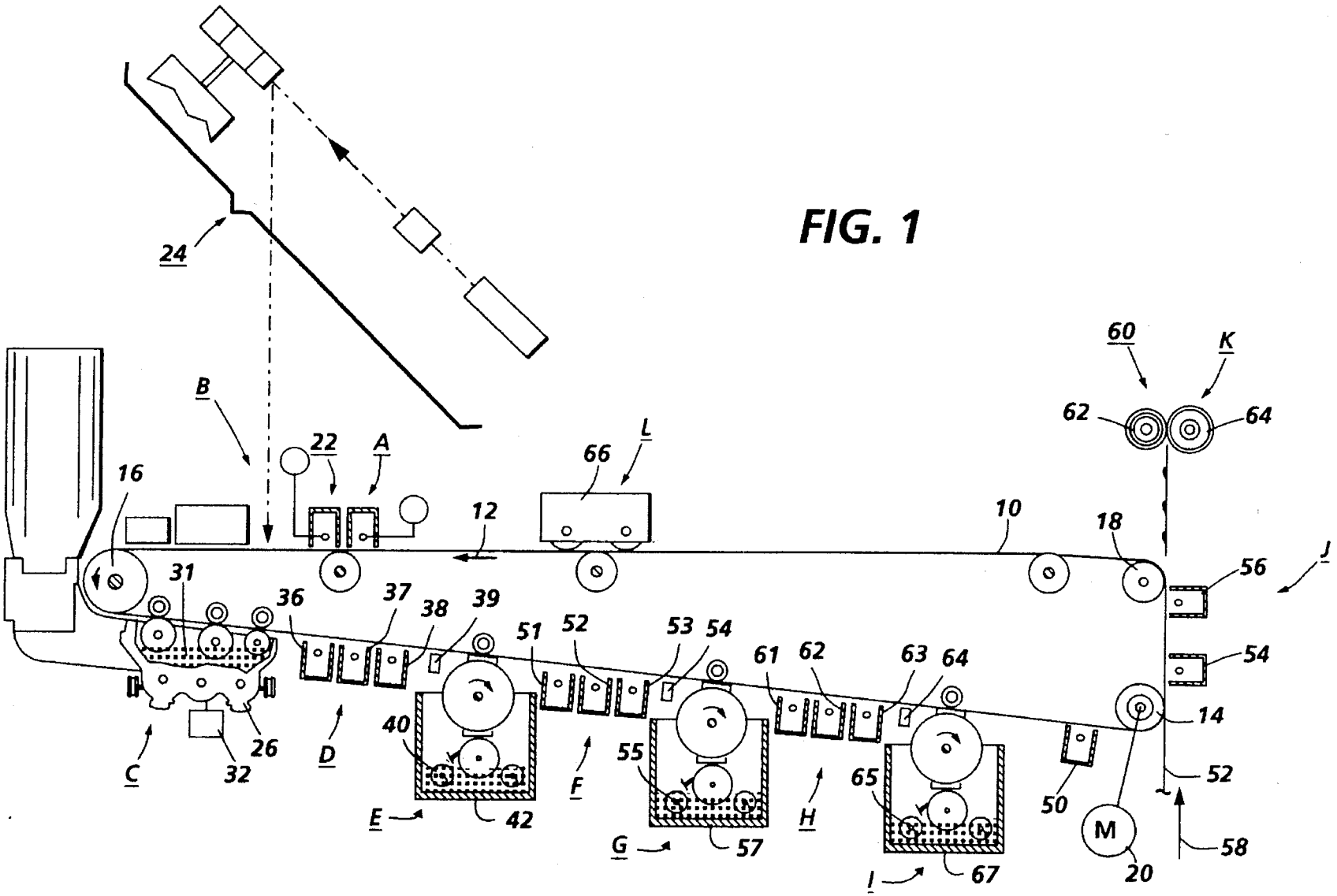
FIG. 1 is a schematic illustration of an imaging apparatus incorporating the features of the present invention.

Turning now to FIG. 1, the electrophotographic printing machine of the present invention uses a charge retentive surface in the form of a negatively charged photoreceptor belt 10 supported for movement in the direction indicated by arrow 12, for advancing sequentially through the various xerographic process stations. The belt is entrained about a drive roller 14 and two tension rollers 16 and 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform potential. For purposes of example, the photoreceptor is negatively charged, however it is understood that the present invention could be useful with a positively charged photoreceptor, by varying the charge levels and polarities of the toners and recharge devices, as will be hereinafter described.

Next, the charged portion of the photoconductive surface is advanced through an imaging or exposure station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices known in the art.

The photoreceptor, which is initially charged to a voltage $V_0$, undergoes dark decay to a level $V_{ddp}$ equal to about −500 volts. When exposed at the exposure station B the image areas are discharged to $V_{DAD}$ equal to about −50 volts. Thus after exposure, the photoreceptor contains a monopolar voltage profile of high and low voltages, the former corresponding to charged areas and the latter corresponding to discharged or image areas.

At a first development station C, a magnetic brush developer structure, indicated generally by the reference numeral 26 advances insulative magnetic brush (IMB) material 31 into contact with the electrostatic latent image. The development structure 26 comprises a plurality of magnetic brush roller members. These magnetic brush rollers present, for example, negatively charged black toner material to the charged image areas for development thereof. Appropriate developer biasing is accomplished via power supply 32. Electrical biasing is such as to effect discharged area development (DAD) of the lower (less negative) of the two voltage levels on the photoreceptor with the material 31.

At recharging station D, three consecutively positioned corona recharge devices 36, 37 and 38 are employed for raising the voltage level of both the toned and untoned areas on the photoreceptor surface to a substantially uniform level. The recharging devices 36, 37 and 38 serve to substantially eliminate any voltage difference between toned areas and bare untoned areas, as well as to reduce the level of residual charge remaining on the previously toned areas, so that subsequent imaging and development of different color toner images is effected across a uniform development field. The surface potential after having passed each of the three corona recharge devices is preselected to otherwise prevent the electrical charge associated with the developed image from reversing in polarity prior to development of a subsequent toner image thereon, so that the occurrence of under color splatter (UCS) is avoided. For example, the first corona recharge device 36 overcharges the photoreceptor surface 10 containing previously toned and untoned areas, to a level higher than the voltage level ultimately required for $V_{ddp}$, for example to −850 volts. The predominant corona charge generated from corona recharge device 36 is negative. The second corona recharge device 37 reduces the photoreceptor surface 10 voltage to −400 volts. Hence, the predominant corona charge delivered from the second corona recharge device 37 is positive. Thus, a first voltage split ($V_{split1}$) Of −450 volts is applied to the photoreceptor surface. The "voltage split" is defined as the difference in photoreceptor surface potential after being recharged by the first corona recharge device and the second corona recharge device, e.g. $V_{split}$=850 volts −400 volts=−450 volts. Finally, the third corona recharge device 38 adjusts the photoreceptor surface voltage to the desired $V_{ddp}$ of −500 volts. Thus the second voltage split ($V_{split2}$) of the photoreceptor is 100 volts. The corona recharge device types and the voltage split ($V_{split}$) amounts are preselected in the recharge configuration of the present invention to ensure that the residual voltage associated with the developed image is substantially eliminated, and that the charge at the top of the toner layer is established at its original polarity (negative in the present embodiment) prior to the development of a subsequent image thereon, rather than some or all of the charge being driven to the reverse polarity (e.g. from negative to become substantially positive). These selected parameters are described in further detail with reference to FIGS. 3A–3F. The presence of reverse polarity toner at the top of the toner layer tends to cause the reverse polarity toner to splatter into neighboring bare regions of the photoreceptor as well as to undesirably mix with the incoming color toner image.

A second exposure or imaging device 39 which may comprise a laser based output structure is utilized for selectively discharging the photoreceptor on toned areas and/or bare areas to approximately −50 volts, pursuant to the image to be developed with the second color developer. After this point, the photoreceptor contains toned and untoned areas at relatively high voltage levels (e.g. −500 volts) and toned and untoned areas at relatively low voltage levels (e.g. −50 volts). These low voltage areas represent image areas which are to be developed using discharged area development. To this end, a negatively charged developer material 40 comprising, for example, yellow color toner is employed. The toner is contained in a developer housing structure 42 disposed at a second developer station E and is presented to the latent images on the photoreceptor by a non-interactive developer. A power supply (not shown) serves to electrically bias the developer structure to a level effective to develop the DAD image areas with the negatively charged yellow toner particles 40.

At a second recharging station F, three consecutively positioned corona recharge devices 51, 52 and 53 are employed for raising the voltage level of both the toned and untoned areas on the photoreceptor surface to a substantially uniform level. The recharging devices 51, 52 and 53 serve to substantially eliminate any voltage difference between toned areas and bare untoned areas, as well as to reduce the level of residual charge remaining on the previously toned areas, so that subsequent imaging and development of different color toner images is effected across a uniform development field. The surface potential after having passed each of the three corona recharge devices is preselected to otherwise prevent the electrical charge associated with the developed image from reversing in polarity prior to the development of a subsequent toner image thereon, so that the occurrence of under color splatter (UCS) is avoided. For example, the first corona recharge device 51 overcharges the photoreceptor surface 10 containing previously toned and untoned areas, to a level higher than the voltage level ultimately required for $V_{ddp}$, for example to −850 volts. The predominant corona charge generated from corona recharge device 51 is negative. The second corona recharge device 52 reduces the photoreceptor surface voltage to −400 volts. Hence, the predominant corona charge delivered from the second corona recharge device 52 is positive. Thus, a first voltage split ($V_{split1}$) of −450 volts is applied to the photoreceptor surface. Finally, the third corona recharge device 53 reduces the photoreceptor surface voltage to the desired $V_{ddp}$ of −500 volts. Thus the second voltage split ($V_{split2}$) of the photoreceptor is 100 volts. The corona recharge device types and the voltage split ($V_{split}$) amounts are preselected to ensure that the residual voltage associated with the developed image is substantially eliminated, and the charge at the top of the toner layer is maintained at its original polarity (negative in the present embodiment) prior to development of a subsequent image thereon. These selected parameters are described in further detail with reference to FIGS. 3A–3F.

A third latent image is created using an imaging or exposure device 54. In this instance, a third DAD image is formed, discharging to approximately −50 volts those bare areas and toned areas of the photoreceptor that will be developed with the third color image. This image is developed using a third color toner 55 contained in a noninteractive developer housing 57 disposed at a third developer station G. An example of a suitable third color toner is magenta. Suitable electrical biasing of the housing 57 is provided by a power supply, not shown.

At a third recharging station H, three consecutively positioned corona recharge devices 61, 62 and 63 are employed for raising the voltage level of both the toned and untoned areas on the photoreceptor surface to a substantially uniform level. The recharging devices 61, 62 and 63 serve to substantially eliminate any voltage difference between toned areas and bare untoned areas, as well as to reduce the level of residual charge remaining on the previously toned areas, so that subsequent imaging and development of different color toner images is effected across a uniform development field. The surface potential after having passed each of the three corona recharge devices is preselected to otherwise prevent the electrical charge associated with the developed image from reversing in polarity prior to development of a subsequent toner image thereon, so that the occurrence of under color splatter (UCS) is avoided. For example, the first corona recharge device 61 overcharges the photoreceptor surface 10 containing previously toned and untoned areas, to a level higher than the voltage level ultimately required for $V_{ddp}$, for example to −850 volts. The predominant corona charge generated from corona recharge device 61 is negative. The second corona recharge device 62 reduces the photoreceptor surface voltage to −400 volts. Hence, the predominant corona charge delivered from the second corona recharge device 62 is positive. Thus, a first voltage split ($V_{split1}$) Of −450 volts is applied to the photoreceptor surface. Finally, the third corona recharge device 63 reduces the photoreceptor surface voltage to the desired $V_{ddp}$ of −500 volts. Thus the second voltage split ($V_{split2}$) of the photoreceptor is 100 volts. The corona recharge device types and the voltage split ($V_{split}$) levels are selected to ensure that the residual voltage associated with the developed image is substantially eliminated, and the charge at the top of the toner layer is maintained at its original polarity. These selected parameters are described in further detail with reference to FIGS. 3A–3F.

A fourth latent image is created using an imaging or exposure device 64. A fourth DAD image is formed on both bare areas and previously toned areas of the photoreceptor that are to be developed with the fourth color image. This image is developed, for example, using a cyan color toner 65 contained in developer housing 67 at a fourth developer station I. Suitable electrical biasing of the housing 67 is provided by a power supply, not shown.

The developer housing structures 42, 57, and 67 are preferably of the type known in the art which do not interact, or are only marginally interactive with previously developed images. For examples, a DC jumping development system, a powder cloud development system, and a sparse, non-contacting magnetic brush development system are each suitable for use in an image on image color development system. A non-interactive, scavengeless development housing having minimal interactive effects between previously deposited toner and subsequently presented toner is described in U.S. Pat. No. 4,833,503, the relevant portions of which are hereby incorporated by reference herein.

In order to condition the toner for effective transfer to a substrate, a negative pre-transfer corotron member 50 discharges positive corona to the side of the photoreceptor opposite to the full color developed image.

Subsequent to image development a sheet of support material 52 is moved into contact with the toner images at transfer station J. The sheet of support material is advanced to transfer station J by conventional sheet feeding apparatus, not shown. Preferably, the sheet feeding apparatus includes a feed roll contacting the uppermost sheet of a stack of copy sheets. The feed rolls rotate so as to advance the uppermost sheet from the stack into a chute which directs the advancing sheet of support material into contact with the photoconductive surface of belt 10 in a timed sequence so that the toner powder image developed thereon contacts the advancing sheet of support material at transfer station J.

Transfer station J includes a transfer corona device 54 which sprays positive ions onto the backside of sheet 52. This attracts the negatively charged toner powder images from the belt 10 to sheet 52. A detack corona device 56 is provided for facilitating stripping of the sheets from the belt 10.

After transfer, the sheet continues to move, in the direction of arrow 58, onto a conveyor (not shown) which advances the sheet to fusing station K. Fusing station K includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from the photoconductive surface of belt 10, the residual toner particles carried by the non-image areas on the photoconductive surface are removed therefrom. These particles are removed at cleaning station L using a cleaning brush structure contained in a housing 66.

The various machine functions described hereinabove are generally managed and regulated by a controller (not shown), preferably in the form of a programmable microprocessor. The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

The recharge devices of stations D, F and H of FIG. 1 have been described generally as corona generating devices. However, it is understood that the corona generating devices for use in the present invention could be in the form of, for example, a corotron, scorotron, pin scorotron, dicorotron, or other voltage sensitive corona charging devices known in the art in which a direct current can be generated therefrom. In the present example having a negatively charged photoreceptor, the negatively charged toner is first recharged, in a preferred embodiment of the invention, by a negative DC scorotron, to a higher negative level. The second corona recharge device is required to generate and deliver a predominantly positive charge to the photoreceptor and toner layers, and therefore a positive DC scorotron is appropriate. The first voltage split applied to the photoreceptor between the first and second scorotrons is sufficiently large so as to substantially eliminate the residual voltage associated with the previously developed toner image, and is in the range of approximately 200 volts to 450 volts, and is preferably in the range of 250 volts to 400 volts. Lastly, the third corona recharge device brings the toner layer charge back to its original negative polarity, and therefore a negative DC scorotron is appropriate. The second voltage split applied to the photoreceptor between the second and third scorotrons need only be sufficiently large so as to ensure that the toner particles of the developed image are restored to their original polarity, and is in the range of approximately 50 volts to 100 volts. In this preferred embodiment of the present invention and as further described with reference to FIGS. 3A–3F, the configuration of a negative, then positive, and then negative direct current being applied to the toner image on the photoreceptor by a voltage sensitive corona recharge device, e.g. a scorotron, accomplishes the stated objectives of achieving voltage uniformity between previously toned areas and untoned areas of the photoreceptor so that subsequent exposure and development steps are effected across a uniformly charged surface; as well as reducing the residual voltage associated with the previously developed areas so that subsequent development steps are effected across a uniform development field. Further, these objectives are successfully attained while ensuring that toner charge at the top of the toner layer is maintained at its original polarity rather than driven to reverse its polarity, so that UCS occurrence is avoided. These advantages are realized without the necessity of neutralizing the charge associated with the image by applying an alternating current to the toner layer, which would otherwise send a large amount of current through the toner layer and into the photoreceptor, making transfer and cleaning of the toner image from the photoreceptor a difficult process. Other advantageous effects of the recharge configuration of the present invention using a voltage sensitive direct current device are realized by the potential cost savings and space savings over use of an AC device in a recharge configuration attempting to achieve comparable results. Furthermore, less ozone is generated, as well is less energy required to generate a direct current from the recharge devices described in the present invention.

Figure 2:
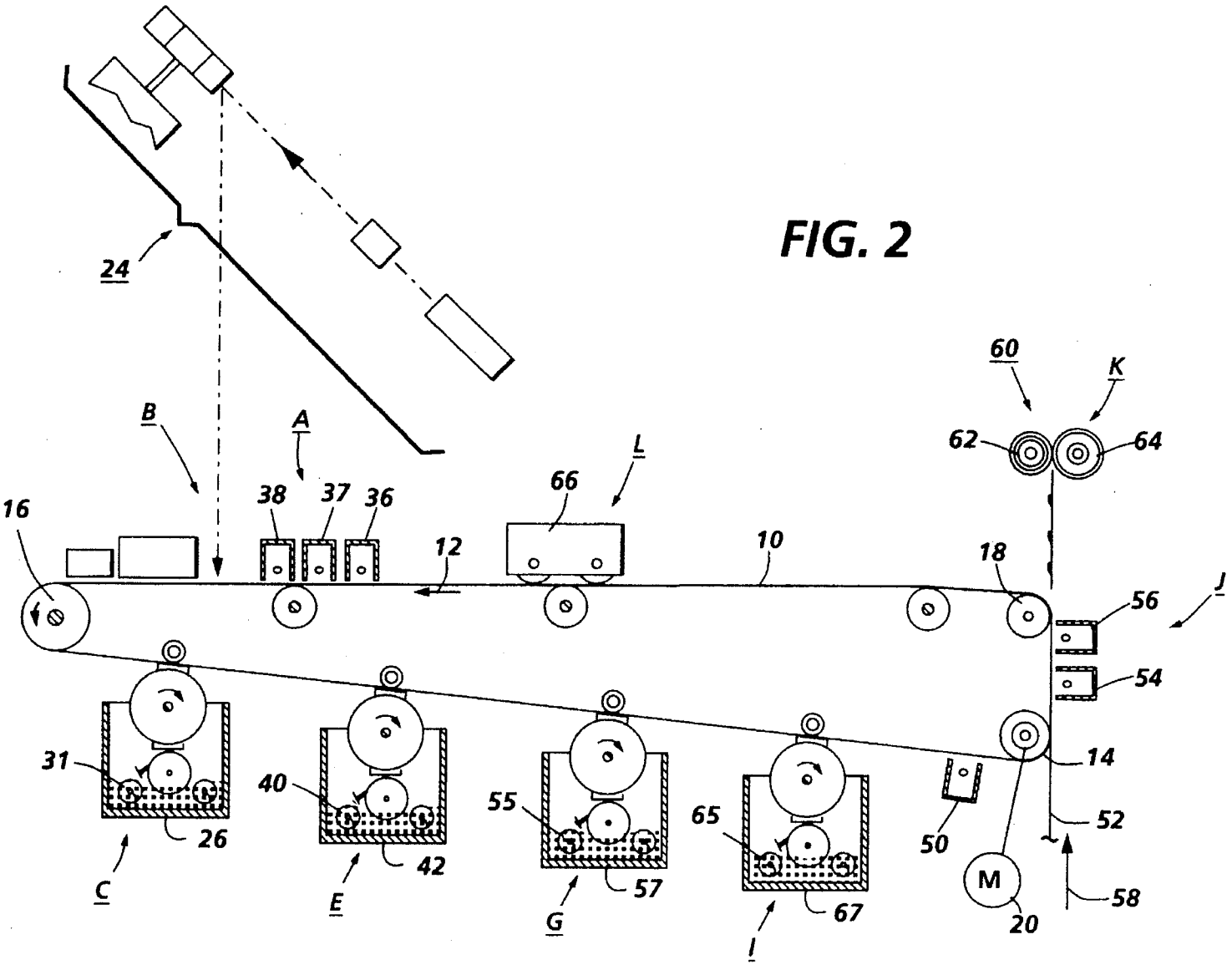
FIG. 2 is a schematic illustration of another imaging apparatus incorporating the features of the present invention.

FIG. 2 illustrates another example of an electrostatographic printing apparatus which would find advantageous use of the present invention. FIG. 2 represents a multiple pass color image formation process, where each successive color image is applied in a subsequent pass or rotation of the photoreceptor. Like reference numerals to those in FIG. 1 correspond with identical elements to those represented in FIG. 2. However, in a multi-pass system as represented in FIG. 2, only a single set of recharging devices, indicated generally at charging/recharging station A, is needed to recharge the photoreceptor surface belt 10 prior to each subsequent color image formation, as well as is only a single exposure device 24 needed to expose the photoreceptor to each color image. In a multi-pass system as shown in FIG. 2, it is preferred that non-interactive or marginally interactive developer housings are used for each different color toner.

Figure 3A:
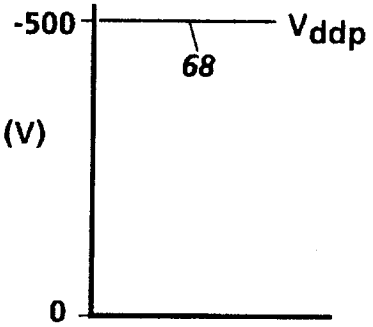
FIG. 3 shows the photoreceptor voltage profile after uniform charging.
FIG. 3D shows the photoreceptor voltage profile after a first recharging step.
FIG. 3E shows the photoreceptor voltage profile after a second recharging step.
FIG. 3F shows the photoreceptor voltage profile after a third recharging step.
Figure 3B:
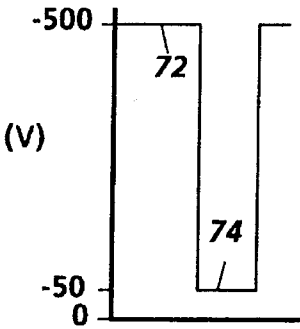

The voltage profiles on the photoreceptor 10 depicting a single split recharge step during the image forming process described with reference to FIGS. 1 and 2 are illustrated in FIGS. 3A through 3F. FIG. 3A illustrates the voltage profile 68 on the photoreceptor belt after the belt surface has been uniformly charged. The photoreceptor is initially charged to a voltage slightly higher than the –500 volts indicated but after dark decay the $V_{ddp}$ voltage level is–500 volts. After a first exposure, the voltage profile comprises high and low voltage levels on a background area and on a toned area, the areas 72 and 74, respectively. The voltage level of the background area 72, which is at the original –500 volts, represents a background area for the first image development step, and the voltage level on the toned area, –50 volts, represents the area discharged by the laser 24 and corresponds to the image area to be developed by a single color toner.

Figure 3C:
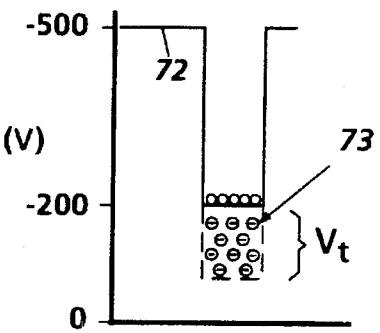
Figure 3D:
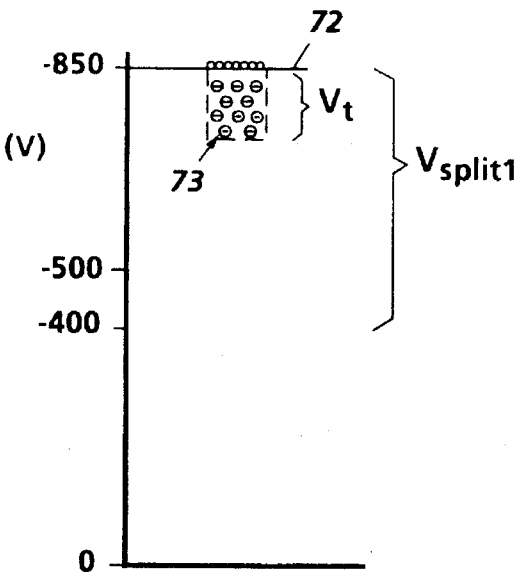

During the first development step, the negatively charged colored toner adheres to the DAD image area and causes the photoreceptor in the image area to be reduced to approximately –200 volts (FIG. 3C). A residual voltage ($V_t$) is associated with the toned image area.

Figure 3E:
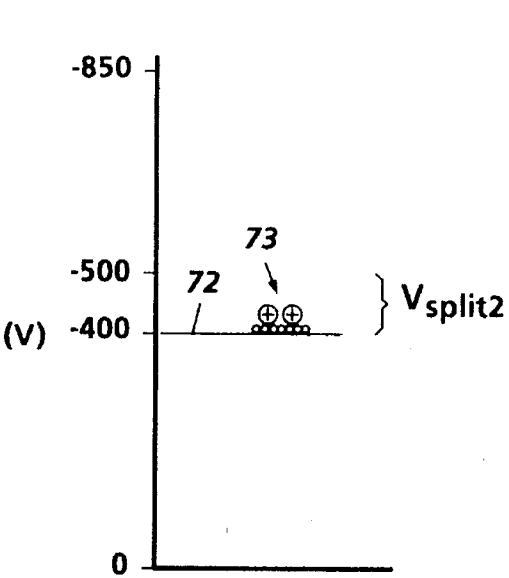
Figure 3F:
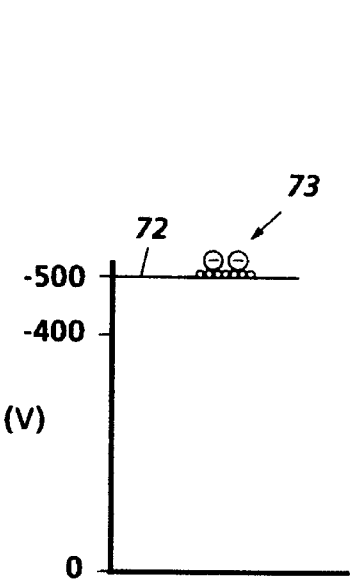

When the image and background area of the photoreceptor are subjected to the recharging step (FIG. 3D) using the split recharge concept of the present invention, the first negative DC corona recharge device 36 overcharges the toned image 73 and background area 72 of the photoreceptor with a direct current to a negatively higher level than the ultimately desired $V_{ddp}$. Thus, after passing the first corona recharge device, the photoreceptor surface having the developed image thereon is charged to approximately –850 volts. The second corona recharge device then applies a positive direct current to the photoreceptor surface to lower the photoreceptor potential to a uniform level of approximately –400 volts (FIG. 3E). Thus, the first voltage split of the photoreceptor surface after being recharged by the first and second corona recharge devices is –450 volts. The substantially high $V_{split1}$ applied to the photoreceptor between the first and second charging devices enables a substantial reduction of the residual charge $V_t$ associated with the toned image 73. Some or all of the charge associated with the toned image 73 is reversed in polarity (i.e. from negative to positive). Finally, the third corona recharge device applies a negative direct current to the photoreceptor surface having a toned image (FIG. 3F), to raise the surface potential to the desired $V_{ddp}$ level of–500 volts. A relatively small $V_{split2}$ of 100 volts is required to return the toner charge to its original polarity state (negative), thereby avoiding the need to drive a large amount of current through the toner image 73.

When developing a subsequent color image on a previously developed image which has a significant amount of reversed polarity toner at the top of the previously developed toner layer, the attraction of the reverse polarity positive toner to the negative background areas tends to cause the under color splatter defect, as previously described, which can significantly impair color image quality. The level of UCS occurrence has been found to be directly related to the amount of reversed polarity toner at the top of a previously developed toner image, i.e. the greater the amount of reversed polarity toner found at the top of the previously developed toner layers, the increased likelihood and amount of UCS occurrence during subsequent exposure and development steps. This has previously limited the amount of $V_{split}$ that could be applied to the photoreceptor surface, which in turn has limited the amount of residual voltage reduction of a previously developed image. However, the present invention advantageously enables a relatively large $V_{split}$ to be applied to the surface, while maintaining the correct polarity of the developed toner image before a subsequent image is developed thereon, so that substantial elimination of the residual charge associated with the toned image is realized, while UCS occurrence is prevented. Furthermore, the absence of reversed polarity toner at the image areas to prevent UCS is realized without the need to use an AC device to substantially neutralize the charge associated with the toner image. Thus, the disadvantageous effect of passing large amounts of current through the toner layer and the photoreceptor is avoided, which would otherwise make difficult the processes of transfer of the image from the photoreceptor and subsequent cleaning of residual toner from the photoreceptor.

After the recharging steps of the present invention, described with reference to FIGS. 3A–3F, substantial voltage uniformity between the toned and untoned regions of the photoreceptor surface is achieved, the residual toner voltage present on the previously developed toner layer is substantially eliminated, and the toner charge at the top of the toner layer is maintained at its original polarity. The photoreceptor with the developed and recharged toner image, is again ready for image formation thereon by a subsequent color toner.

While the foregoing description was directed to a DAD$^n$ image on image process color printer where a full color image is built in a single pass of the charge retentive surface, it will be appreciated that the invention may also be used in a charged area development CAD$^n$ or CAD-DAD$^n$ in both single pass or multiple pass systems, as well as in a single or multiple highlight color process machine.

What is claimed is:

1. A corona generating apparatus for recharging a charge retentive surface to a predetermined potential, wherein the charge retentive surface has an image developed thereon having an electrical charge of a first polarity associated therewith, comprising:

a first corona generating device for recharging the charge retentive surface to a higher absolute potential than the predetermined potential;

a second corona generating device for recharging the charge retentive surface to a lower absolute potential than the predetermined potential after said first corona generating device recharges the charge retentive surface to a higher absolute potential than the predetermined potential; and a third corona generating device for recharging the charge retentive surface to the predetermined potential after said second corona generating device recharges the charge retentive surface to a lower absolute potential than the predetermined potential.

2. The corona generating apparatus according to claim 1, wherein the first polarity of the electrical charge is restored to the developed image after said third corona generating device recharges the charge retentive surface.

3. The corona generating apparatus according to claim 1, wherein:

said first corona generating device delivers a direct current to the charge retentive surface;

said second corona generating device delivers a direct current to the charge retentive surface; and said third corona generating device delivers a direct current to the charge retentive surface.

4. The corona generating apparatus according to claim 1, wherein the charge retentive surface has a difference in potential after being recharged by said first corona generating device and said second corona generating device, ranging from about 200 volts to about 450 volts.

5. The corona generating apparatus according to claim 1, wherein the charge retentive surface has a difference in potential after being recharged by said first corona generating device and said second corona generating device, ranging from about 250 volts to about 400 volts.

6. The corona generating apparatus according to claim 1, wherein the charge retentive surface has a difference in potential from the predetermined potential, after being recharged by said second corona generating device and the predetermined potential, ranging from about 50 volts to about 100 volts.

7. A printing machine, comprising:

a charge retentive surface having a developed image thereon, the developed image having an electrical charge of a first polarity associated therewith; and a corona generating apparatus for recharging said charge retentive surface to a predetermined potential, said corona generating device including:

a first corona generating device for recharging the charge retentive surface to a higher absolute potential than the predetermined potential;

a second corona generating device for recharging the charge retentive surface to a lower absolute potential than the predetermined potential after said first corona generating device recharges the charge retentive surface to a higher absolute potential than the predetermined potential; and a third corona generating device for recharging the charge retentive surface to the predetermined potential after said second corona generating device recharges the charge retentive surface to a lower absolute potential than the predetermined potential.

8. The printing machine according to claim 7, wherein the first polarity of the electrical charge is restored to the developed image after said third corona generating device recharges the charge retentive surface.

9. The printing machine according to claim 7, wherein:

said first corona generating device delivers a direct current to the charge retentive surface;

said second corona generating device delivers a direct current to the charge retentive surface; and said third corona generating device delivers a direct current to the charge retentive surface.

10. The printing machine according to claim 7, wherein the charge retentive surface has a difference in potential after being recharged by said first corona generating device and said second corona generating device, ranging from about 200 volts to about 450 volts.

11. The printing machine according to claim 7, wherein the charge retentive surface has a difference in potential after being recharged by said first corona generating device and said second corona generating device, ranging from about 250 volts to about 400 volts.

12. The printing machine according to claim 7, wherein the charge retentive surface has a difference in potential from the predetermined potential, after being recharged by said second corona generating device and the predetermined potential, ranging from about 50 volts to about 100 volts.

13. The printing machine according to claim 7, wherein multiple images are created during one revolution of said charge retentive surface, further comprising means for developing each of the multiple images with a different color toner, whereby a composite color image is created.

14. A method for creating multiple images, comprising:

(a) recharging a charge retentive surface to a higher absolute potential than a predetermined potential;

(b) recharging the charge retentive surface to a lower absolute potential than the predetermined potential after said step (a); and (c) recharging the charge retentive surface to the predetermined potential after said step (b).

15. The method according to claim 14, wherein:

said step (a) further comprises generating a direct current from a first corona generating device and delivering the direct current to the charge retentive surface;

said step (b) further comprises generating a direct current from a second corona generating device and delivering the direct current to the charge retentive surface; and said step (c) further comprises generating a direct current from a third corona generating device and delivering the direct current to the charge retentive surface.

16. The method according to claim 14, wherein said step (a) and said step (b) recharge the charge retentive surface so that the charge retentive surface has a difference in potential ranging from about 200 volts to about 450 volts.

17. The method according to claim 14, wherein said step (a) and said step (b) recharge the charge retentive surface so that the charge retentive surface has a difference in potential ranging from about 250 volts to about 400 volts.

18. The method according to claim 14, wherein said step (b) and said step (c) recharge the charge retentive surface so that the charge retentive surface has a difference in potential ranging from about 50 volts to about 100 volts.

19. The method according to claim 14, further comprising creating the multiple images during one revolution of the charge retentive surface.

20. The method according to claim 14, further comprising developing each of the multiple images with a different color toner to form a composite color image.

* * * * *